United States Patent [19]

Olsen

[11] 4,064,989

[45] Dec. 27, 1977

[54] SHIPPING CARTON CONSTRUCTION

[75] Inventor: Robert Charles Olsen, Streamwood, Ill.

[73] Assignee: Illinois Tool Works Inc., Chicago, Ill.

[21] Appl. No.: 703,988

[22] Filed: July 9, 1976

[51] Int. Cl.[2] ..... B65D 65/32

[52] U.S. Cl. ..... 206/428; 206/150; 206/151; 206/628

[58] Field of Search ..... 206/428, 150, 151, 498; 229/51 TS

[56] References Cited

U.S. PATENT DOCUMENTS

| | | | |
|---|---|---|---|
| 2,997,169 | 8/1961 | Poupitch | 206/150 |
| 3,038,602 | 6/1962 | Rapata | 206/150 |
| 3,084,792 | 4/1963 | Poupitch | 206/150 |
| 3,202,448 | 8/1965 | Stern et al. | 206/151 |
| 3,325,004 | 6/1967 | Wanderer | 206/150 |
| 3,330,408 | 7/1967 | Wanderer | 206/150 |
| 3,374,028 | 3/1968 | Wanderer | 206/150 |
| 3,721,337 | 3/1973 | Braun et al. | 206/150 |

*Primary Examiner*—William Price
*Assistant Examiner*—Douglas B. Farrow
*Attorney, Agent, or Firm*—Edward L. Benno; Robert W. Beart

[57] ABSTRACT

A shipping carton construction comprising a closed carton containing a plurality of containers. The containers upstand in the carton in side-by-side abutting positions and are arranged in groups with a packaging device for each group. The packaging device is formed from a resilient deformable plastics sheet material in the shape of a plurality of bands arranged in two adjacent rows. The bands are circumferentially applied about the individual containers to separate and cushion the individual containers in a spaced-apart relationship so that in transport and handling, containers having a high finish are not scratched or marred. The containers are cylindrical and have a substantial upper chime such as particularly used in the distribution of aerosol spray products, and each of the bands of the group packaging devices has a particularly formed and arranged plastics tab that projects upwardly over the container chime to further cushion adjacent packaged groups and to prevent the chimes of one group from overriding or climbing the chimes of another group in the transport and handling of the carton. Each of the tabs is further provided with a particular slit that does not weaken the stretched container encircling bands nor interfere with the cushioning function of the tabs, but permits the bands to be easily fractured by a person such as a grocery or supermarket clerk when the carton has been opened and the containers are to be removed and placed on the store shelves.

3 Claims, 5 Drawing Figures

SHIPPING CARTON CONSTRUCTION

BACKGROUND OF THE INVENTION

In the prior art a number of different carton arrangements are commonly used for protecting containers having a high finish. One common arrangement involves the use of corrugated paperboard dividers interlocked to form individual pockets in the carton for each container. Such arrangements while adequately cushioning and protecting individual containers in a shipping carton, do not permit groups of the containers to be removed from the shipping carton as a unit where, for example, a distributor or shipping clerk must handle or distribute containers of the carton in less than a full case lot before final placement on a store shelf. Where such further distribution in less than case lots is necessary prior known arrangements generally involve a cardboard sleeve for packaging a subgroup of the total number of containers in the carton, with a number of such subgroups making up a full case lot or shipping carton. Such sleeves adequately cushion individual containers in the case or carton and further allow a shipping clerk to remove and further handle groups of the containers as a unit prior to final placement of individual containers on a store shelf. The major disadvantage of paperboard or cardboard dividers or sleeves in shipping cartons is the expense of such arrangements because of the relatively large amount of paperboard material involved in such constructions.

Packaging of a plurality of containers into groups to form a retail multipackage for use by a retail customer in purchasing a group of multipackaging containers is well-known in the form of a plurality of integrally interconnected plastic bands or rings such as shown, for example, in U.S. Pat. No. 2,874,835. While such carriers or multipackaging devices have had various forms of tabs for preventing chime override in the shipment of such multipackages and while such multipackaging devices or carriers have also included various arrangements for fracturing the plastic bands to remove individual containers, none of the prior known devices are adequate for a case or shipping carton arrangement where the containers must be adequately separated and cushioned from each other, where means must be provided to prevent chime override, where subgrouping of the containers in a shipping carton is required, and where the individual containers must be quickly and easily separated from the encircling bands to permit rapid break down of a carton and subgroups in distribution and store shelf stocking procedures.

SUMMARY OF THE INVENTION

The present invention involves a shipping carton or case construction including cylindrical containers having a substantial upper chime with the containers arranged in an upstanding side-by-side position in the carton, and with the containers arranged in subgroups by a packaging device comprising a sheet of resilient plastics material formed as a plurality of integrally interconnected bands arranged in two rows. Each of the bands of the packaging devices is stretched and circumferentially encircles one of the containers immediately below the upper chime thereof. Each packaging device separates and cushions the containers therein to prevent scratching or marring of the outer surface of the containers. Each carrier device further includes a tab formed to extend from the inner periphery of the outer band segment of each band, with each tab extending upwardly to overlie the chime of the container in that band. In the carton, the subgroups are arranged so that adjacent subgroups are further separated and cushioned by adjacent tabs. Thus, each tab in addition to preventing chime override cooperates with the adjacent abutting tab to add further cushioning and container separation in the shipping carton arrangement.

Each tab is further provided with a slit partially therethrough. The slits are so arranged that while directed toward the contiguous outer band segment, the slits do not extend into the outer band segments and thereby avoid weakening and possible accidental fracture of the stretched bands encircling the containers. An arrow legend is impressed in each of the tabs indicating a direction in which the tab should be pulled by a person desiring to remove a container from its encircling band. The arrangement of the arrow legend and the direction of the slit provide a construction that permits easy and rapid fracture of the bands to enable a stock clerk to quickly and easily break down a case and place the individual containers on a store shelf.

Other objects and features of the invention will be apparent upon a perusal of the hereinafter following detailed description read in conjunction with the drawings.

DETAILED DESCRIPTION OF THE PREFERRED EMBODIMENT

Figure 1:
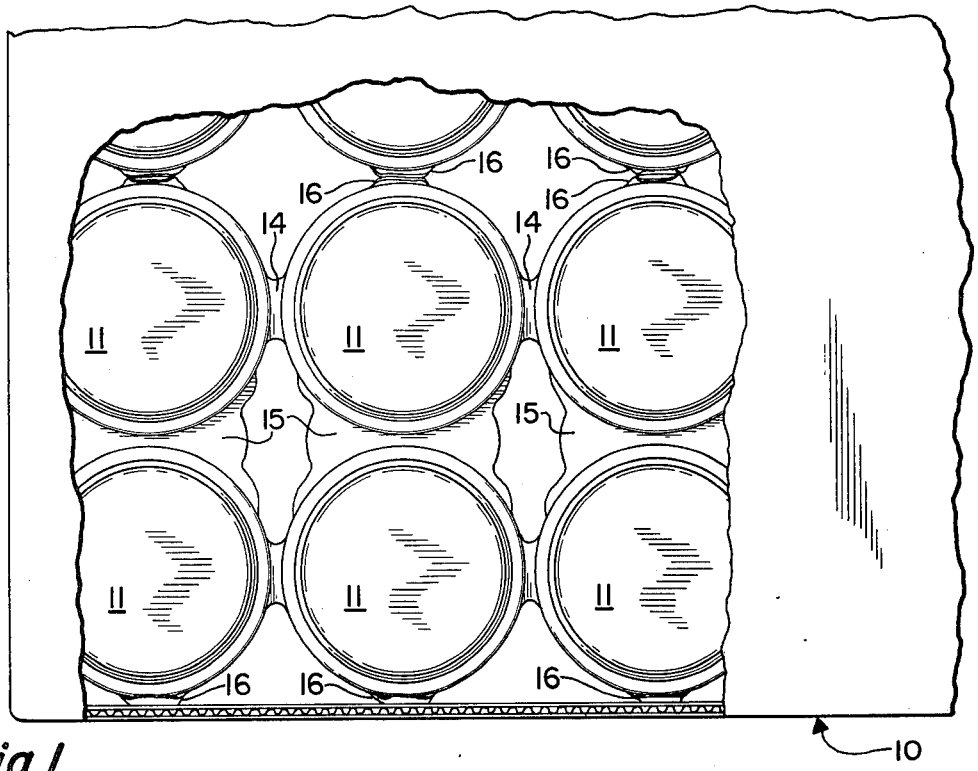
FIG. 1 is a top plan view of a portion of a case of containers constructed and arranged according to the invention.

FIG. 1 shows a top plan view of a fragmentary portion of a shipping carton 10 used in the subject invention. Such cartons, commonly are made of a corrugated paperboard material, are rectangular in shape and comprise four side walls, a top and a bottom wall. The carton is generally shipped and handled in a sealed condition with a plurality of articles such as containers 11 carried therein. The containers are arranged in upstanding side-by-side condition and the carton is generally sized to carry a convenient number of containers such as 24.

Figure 2:
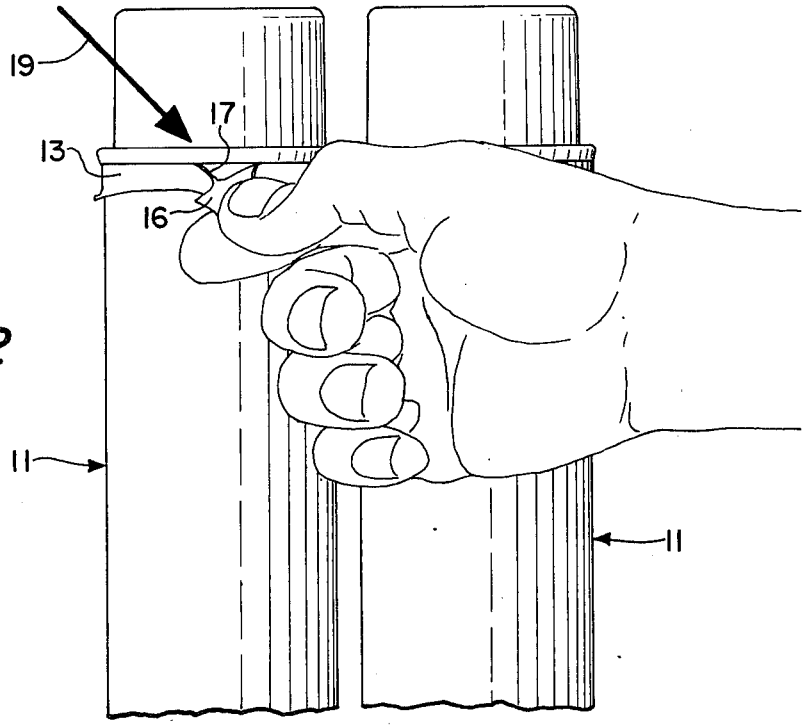
FIG. 2 is a side elevational view of a group of containers removed from the shipping carton of FIG. 1 and showing how a person removes individual containers from the group.
Figure 4:
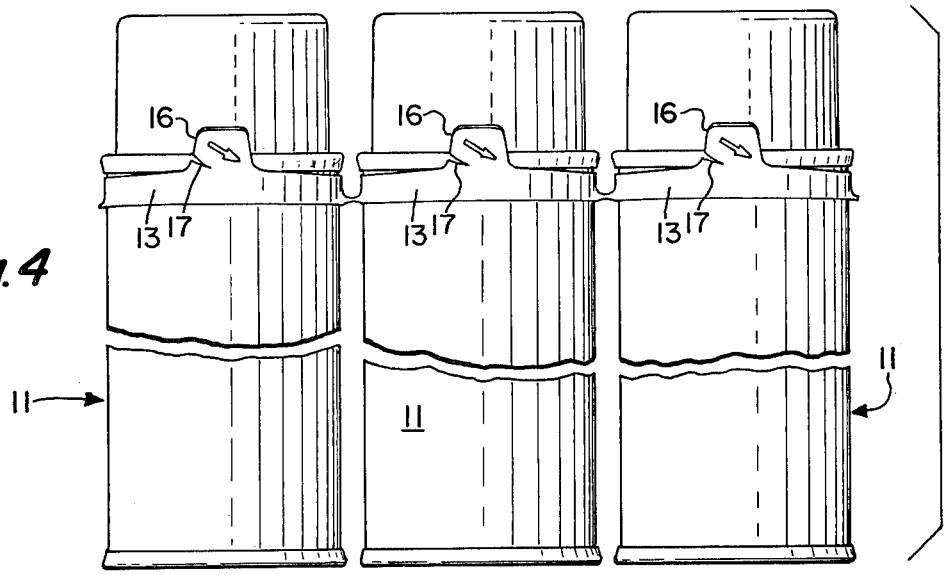
FIG. 4 is a side elevational view of one group of containers with the packaging device of FIG. 3 mounted thereon.

The containers 11, as shown, are containers having an overcap such as shown in FIGS. 2 and 4. Such containers are commonly used for the distribution of aerosol products with the aerosol spray nozzle being contained beneath the overcap. Such containers generally have an upper chime that extends substantially radially outwardly of the outer side wall surface of the containers with the overcap being snapped or otherwise secured within the upper chime of the container. Further, such aerosol containers as consumer products generally have a high and decorative finish on the outer sidewall surface of the container that is not to be scratched or marred in the transport and handling of the container to the store shelf.

Figure 3:
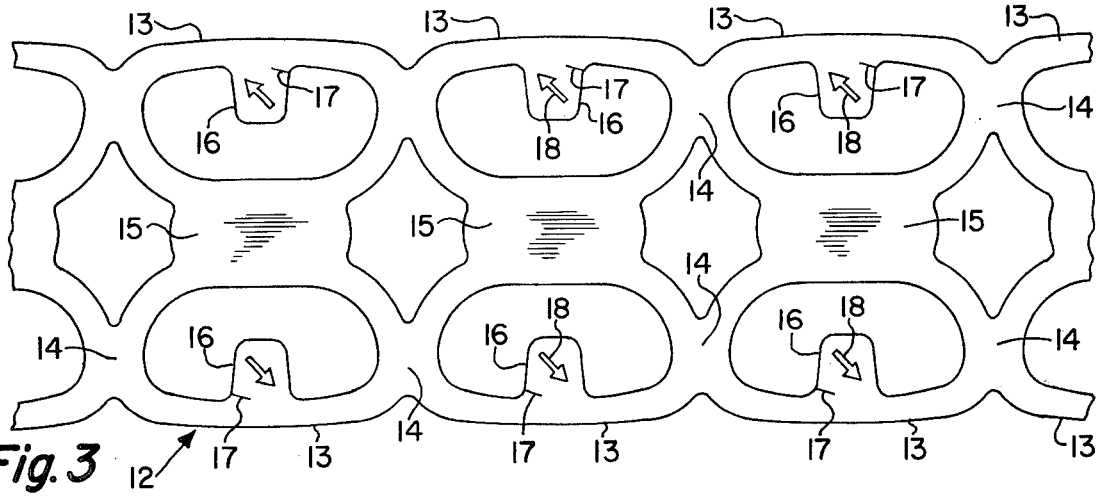
FIG. 3 is a plan view of a section of the plastics material packaging device in its original condition before application to the containers.

The containers 11 are separated and cushioned in the carton 10 by a packaging device which is shown in its initial manufactured strip form in FIG. 3. The strip 12 is formed from a resilient deformable sheet of plastics material in the shape of two rows of bands 13. The adjacent bands in each row are integrally interconnected by webs 14. Each pair of transversely aligned bands 13 in the strip 12 are integrally interconnected by webs 15.

Each of the bands 13 is elongated in the direction of the rows of the strip 12 and the inner peripheral dimension of each of the bands 13, extended through the tabs 16 is less than the circumferential dimension of the outer sidewall surface of the containers 11 below their upper chimes. The outer peripheral dimension of each of the bands 13, extended through the webs 14 and 15, is at least as great as the circumferential dimension of the outer sidewall surface of the containers 11 below the upper chimes.

The strip 12 is used to make a package group of containers 11 by transversely severing the strip 12 through the webs 14 at selected spaced-apart positions longitudinally of the strip 12. The invention contemplates that in making the strip 12, the webs 14 and 15 may be provided with slits which will permit packaging devices to be taken from the strip by a fracturing of the webs rather than by severance, and further, that such slits may be useful for breaking down large groups into smaller groups for further distribution. As shown in FIGS. 1, 2, 4 and 5, the strip 12 has been transversely severed to provide two rows of three bands 13 in each row. The inner periphery of each of the bands 13 is stretched and each band 13 is then circumferentially applied about the outer sidewall surface of one of the containers 11 immediately below the upper chime. In the applied condition of the carrier device, the bands 13 assume a substantially frusto-conical shape on the containers 11. In the application of the bands 13 to the containers 11, the necessary number of bands 13 may be applied to a group of containers either before or after the noted severance of the appropriate webs 14.

As may be seen in the drawings, each of the bands 13 is further provided with an integral tab 16 which is formed to extend from the inner periphery of each band 13. Each tab 16 is positioned on the outer band segment of a band 13 and substantially at the longitudinal center of the outer band segment. In the stretched and applied condition of the bands 13 to the containers 11, the tabs 16 extend upwardly and over the upper chimes of the containers 11 as may be seen in FIG. 4. The upper ends of the tabs 16 extend substantially above the upper edges of the upper chimes and further cover a substantial circumferential segment of the upper chimes of the containers 11. When groups of containers 11 with the packaging devices mounted thereon are placed in the carton as shown in FIG. 10, the tabs 16 of adjacent groups will abut, such as shown in FIG. 1. In that condition the upper chimes of one group of containers can not override the chimes of an adjacent group when the closed carton is jostled or otherwise roughly handled in the commercial transport of the carton. Further, as is apparent from FIG. 1, the tabs 16 serve to separate and cushion adjacent groups of containers in the carton. Of course, the adjacent containers within each group are separated and cushioned from each other by the webs 14 and 15 of the packaging device.

Each of the tabs 16 is provided with a slit 17. Each slit 17 extends from one side of the band 16 partially therethrough and generally toward the other side of the tab. Each slit 17 is further disposed at an acute angle to a line drawn through the base of the tab 16 as an extension of the inner periphery of the band 13. Each slit 17 further terminates in its tab 16 at or short of the line extension of the inner periphery of the band 13 through the tab 16. The described alignment of each slit 17 is important for a number of reasons. Firstly, the slits 17 must not weaken the outer band segments so that in the stretching and application of the bands 13 to the containers 11, or after the bands have been applied to the containers 11 and the packaged groups are handled and transported, the slits might open through the outer band segments and thereby cause band fractures before intentional break down of the groups. Most resilient plastics materials, such as low density polyethylene, have what is called low notch resistance which means that once such a plastics material is notched or slit, the material is further easily torn or separated along the line of the slit.

Figure 5:
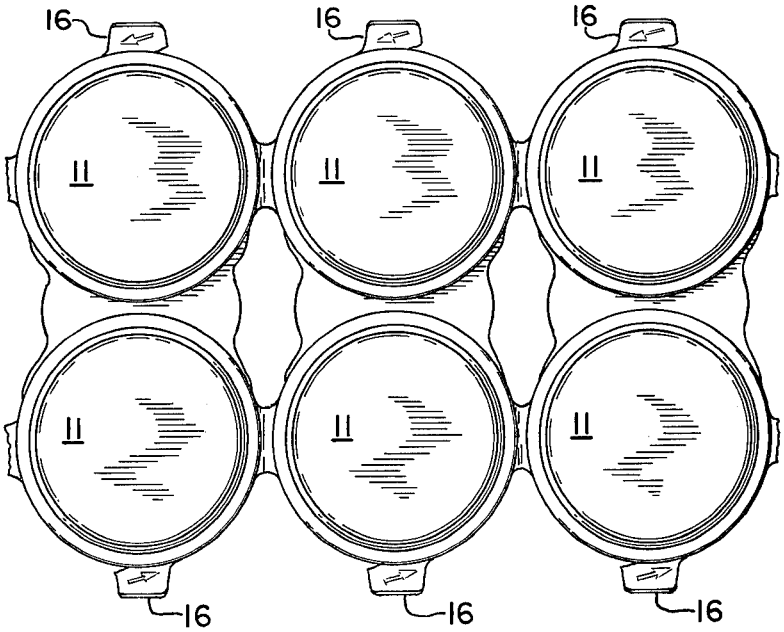
FIG. 5 is a top plan view of the group of packaged containers of FIG. 4.

The second important reason for the defined arrangement of the slits 17 involves the desired intentional fracture of each band 13 when the groups of containers 11 are to be broken down with a stacking of individual containers on a store shelf. The acute angle of each slit 17, and the addition of an impressed arrow legend 18, insures that when a person grasps a tab 16 and pulls on the tab 16 in the direction of the arrow 18 impressed thereon, or generally in the direction of the arrow 19 as shown in FIG. 2, the person will not merely tear the tab 16 from the band 13, but will tear the outer band segment therethrough with the tab remaining on one fractured end of the outer band segment. Each of the arrow legends 18 impressed in the tabs 16 is aligned on a tab 16 at an acute angle to the line of the slit 17 and directed toward the outer band segment of the band 13. Reductions to practice of the subject invention have shown that the bands 13 are remarkably easily and quickly fractured when the tabs 16 are pulled as described and yet, the groups of containers 11 in the assembled condition with the carrier devices are readily handled by a person in groups, such as shown in FIGS. 4 and 5, without undesirable or accidental fracturing of the outer band segments. Further, reductions to practice of the invention have been subjected to shipping tests in which the closed cartons 10 have been vibrated, jostled, dropped, and otherwise relatively roughly handled, and it has been found that the slits 17 have not opened through the outer band segments to cause undesirable advance fracture of the bands 13.

Having described the invention, it is to be understood that changes can be made in the described embodiment by one skilled in the art within the spirit and scope of the invention as defined in the hereinafter following claims.

I claim:

1. A package comprising a shipping carton and a plurality of groups of cylindrical containers carried in said carton in upstanding side-by-side abutting positions, each of said containers having an upper chime extending radially outwardly of the outer side wall surface thereof, the outer diameter of said chime being greater than the maximum diameter of the outer side wall of said containers, a packaging device mounted on each of said groups of containers, each of said packaging devices comprising a sheet of resilient plastics material formed in the shape of a plurality of bands arranged in two adjacent rows, first webs integrally interconnecting the adjacent bands in each row, second webs integrally interconnecting the transversely adjacent bands in said two adjacent rows, each of said bands being elongated in the direction of said rows, a tab integrally formed on each of said bands on the outer band segment of each band substantially at the longitudinal center thereof and extending from the inner periphery of each band, the initial inner peripheral dimension of each of said bands being less than the circumferential dimension of the outer side wall surface of said containers, each of said tabs having a slit extending from one side thereof and substantially into said tab, each of said slits being aligned in said tabs at an acute angle to an imaginary line drawn through said tabs as an extension of the inner periphery of said outer band segment therethrough, and each of said slits positioned in said tabs short of any crossing of said imaginary line into said outer band segments, the distance between the end of each of said slits in said tabs and the other side of each of said tabs opposed to said one side thereof being substantially greater than the transverse width of said outer band segments of each band adjacent to said tabs, each of the bands of said packaging devices being substantially stretched and circumferentially embracing the outer side wall surface of one of said containers with the inner periphery of the band immediately below the upper chime of said container and with the tab of the band extending upwardly to cover said upper chime, and said groups of containers arranged in said carton with the tabs of adjacent packaging devices in an abutting relationship.

2. In a package as defined in claim 1, and each of said tabs having an arrow legend impressed therein and aligned at an acute angle to the line of the slit therein and directed toward the outer band segment.

3. A packaging device for resiliently supporting and separating a plurality of cylindrical containers in a shipping carton, said packaging device comprising a sheet of resilient plastics material formed in the shape of a plurality of bands arranged in two adjacent rows, first webs integrally interconnecting the adjacent bands in each row, second webs integrally interconnecting the transversely adjacent bands in said two adjacent rows, each of said bands being elongated in the direction of said rows, a tab integrally formed on each of said bands on the outer band segment of each band substantially at the longitudinal center thereof and extending from the inner periphery of each band, the inner peripheral dimension of each of said bands being less than the circumferential dimension of the outer sidewall surface of said containers, the outer peripheral dimension of each of said bands being at least as great as the circumferential dimension of the outer sidewall surface of said containers, each of said tabs having a slit extending from one side thereof and substantially into said tab, each of said slits being aligned in said tabs at an acute angle to an imaginary line drawn through said tabs as an extension of the inner periphery of said outer band segments therethrough, each of said slits positioned in said tabs short of any crossing of said imaginary line into said outer band segments, and the distance between the end of each of said slits in said tabs and the other side of each of said tabs opposed to said one side thereof being substantially greater than the transverse width of said outer band segments of each band adjacent to said tabs.

* * * * *